US009366434B2

(12) United States Patent
Cody et al.

(10) Patent No.: US 9,366,434 B2
(45) Date of Patent: Jun. 14, 2016

(54) VARIABLE AIR TO PRODUCT RATIO WELL BURNER NOZZLE

(71) Applicant: Halliburton Energy Services, Inc., Houston, TX (US)

(72) Inventors: Trace Wayne Cody, Dallas, TX (US); Brian David Higgins, Flower Mound, TX (US); Gary Dean Schuerman, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/236,574

(22) PCT Filed: Feb. 1, 2013

(86) PCT No.: PCT/US2013/024264

§ 371 (c)(1),
(2) Date: Jan. 31, 2014

(87) PCT Pub. No.: WO2014/120230

PCT Pub. Date: Aug. 7, 2014

(65) Prior Publication Data

US 2015/0330630 A1 Nov. 19, 2015

(51) Int. Cl.
*F23N 1/02* (2006.01)
*F23N 3/00* (2006.01)
(Continued)

(52) U.S. Cl.
CPC ..... *F23N 3/007* (2013.01); *F23D 11/102* (2013.01); *F23D 11/38* (2013.01); *F23D 11/40* (2013.01); *F23D 14/48* (2013.01); *F23D 14/62* (2013.01); *F23D 23/00* (2013.01); *F23D 91/02* (2015.07)

(58) Field of Classification Search
CPC ..... F23R 3/286; F02D 19/081; F02M 21/042; F02M 25/0793; F02M 21/0239; F02M 21/04; F23D 11/101; F23D 11/102; F23C 7/008; E21B 2034/007; F16K 11/00; F16K 11/065; F16K 11/07; F16K 27/041; F16K 17/04; Y10T 137/0396
USPC ..... 251/37; 137/613, 625.12; 431/12
See application file for complete search history.

(56) References Cited

U.S. PATENT DOCUMENTS 3,185,202 A 5/1965 Mitchell et al.
3,565,562 A 2/1971 Drivet
(Continued)

FOREIGN PATENT DOCUMENTS

EP 0454351 4/1991
JP 04-225705 8/1992
(Continued)

OTHER PUBLICATIONS

PCT International Preliminary Report on Patentability, PCT/US2013/024264, Aug. 13, 2015, 8 pages.
(Continued)

*Primary Examiner* — Kenneth Rinehart
*Assistant Examiner* — Jason Lau
(74) *Attorney, Agent, or Firm* — John W. Wustenberg; Fish & Richardson P.C.

(57) ABSTRACT

A well test burner system includes a plurality of burner nozzles. At least one of the burner nozzles includes a well product inlet, an air inlet, an air/well product mixture outlet, and an automatic valve. The automatic valve is configured to automatically adjust a ratio of air and well product supplied to the air/well product mixture outlet based on the well product received via the well product inlet.

16 Claims, 2 Drawing Sheets

(51) Int. Cl.

| | |
|---|---|
| ***F23D 14/48*** | (2006.01) |
| ***F23D 14/62*** | (2006.01) |
| ***F23D 11/10*** | (2006.01) |
| ***F23D 11/38*** | (2006.01) |
| ***F23D 11/40*** | (2006.01) |
| ***F23D 23/00*** | (2006.01) |

(56) References Cited

U.S. PATENT DOCUMENTS

| | | | | |
|---|---|---|---|---|
| 3,894,831 | A | 7/1975 | Glotin et al. | |
| 3,980,416 | A | 9/1976 | Goncalves et al. | |
| 4,011,995 | A | 3/1977 | Krause, Jr. | |
| 4,270,561 | A | 6/1981 | Bjorklund | |
| 4,348,171 | A | 9/1982 | Issenmann | |
| 4,412,811 | A | 11/1983 | Pedrosa Junior et al. | |
| 4,655,706 | A | 4/1987 | Bayh, III | |
| 5,044,558 | A | 9/1991 | Young et al. | |
| 5,058,808 | A | 10/1991 | Young | |
| 5,096,124 | A | 3/1992 | Young | |
| 5,360,334 | A | 11/1994 | Kagi, Sr. | |
| 5,464,344 | A | 11/1995 | Hufton | |
| 5,636,980 | A * | 6/1997 | Young | F23D 11/102 239/403 |
| 5,918,670 | A | 7/1999 | Coutts et al. | |
| 5,993,196 | A | 11/1999 | Young et al. | |
| 6,027,332 | A | 2/2000 | Glotin et al. | |
| 6,036,479 | A | 3/2000 | Dubach et al. | |
| 7,566,217 | B2 * | 7/2009 | Morsner | F23C 7/008 431/12 |
| 2006/0127831 | A1 | 6/2006 | Kagi, Sr. | |
| 2007/0248920 | A1 | 10/2007 | Morsner | |
| 2011/0226218 | A1 * | 9/2011 | Vongsateanchai | F02M 35/10216 123/437 |

FOREIGN PATENT DOCUMENTS

| | | |
|---|---|---|
| JP | 11-022915 | 1/1999 |
| WO | WO94-08178 | 4/1994 |

OTHER PUBLICATIONS

Authorized Officer Joong Sub Han, PCT International Search Report and Written Opinion of the International Searching Authority, PCT/US2013/024264, Oct. 22, 2013, 11 pages.
DPIR, "The Derwent Environmental Crude Oil Burner", Jul. 2011, 3 pages.
Expro, "Sea Emerald Burner System", Jun. 2011, 2 pages.
Flare Industries, "Peacock Oil Burner", Apr. 2009, 2 pages.
John Zink Company LLC, "Flare Systems", Copyright 2001, 3 pages.
Schlumberger, "EverGreen Burner", Apr. 2011, 2 pages.
Cody et al., "Vertically Arranged Well Test Burner System", PCT/US2013/024266, Feb. 1, 2013, 12 pages.
Cody et al., "Signal Responsive Well Test Burner", PCT/US2013/024275, Feb. 1, 2013, 15 pages.
Cody, "Aimable Well Test Burner System", PCT/US2013/024281, Feb. 1, 2013, 13 pages.

* cited by examiner

VARIABLE AIR TO PRODUCT RATIO WELL BURNER NOZZLE

This application is a 371 National Phase of and claims the benefit of priority to PCT Application Serial No. PCT/US2013/024264, filed on Feb. 1, 2013 and entitled "Variable Air to Product Ratio Well Buner Nozzle", the contents of which are hereby incorporated by reference.

BACKGROUND

Prior to connecting a well to a production pipeline, a well test is performed where the well is produced and the production evaluated. The product collected from the well (e.g., crude oil and gas) must be disposed of In certain instances, the product is separated and a portion of the product (e.g., substantially crude) is disposed of by burning using a surface well test burner system. For example, on an offshore drilling platform, the well test burner system is often mounted at the end of a boom that extends outward from the side of the platform. As the well is tested, the crude is piped out the boom to the well test burner system and burned. Well test burner systems are also sometimes used on land-based wells.

From an environmental standpoint, it is desirable to have efficient, complete combustion of the product with minimal smoke or oil fallout. The efficiency of the combustion is tied to the air-to-product ratio produced by burner nozzles of the well test burner system. Some well test burner systems have multiple burner nozzles, each sized to produce the proper air-to-product ratio at a specified product flow rate. Therefore, as the volume of product changes, the number of burner nozzles used in burning the product is adjusted by manually opening and closing air and well product supply valves to the burner system to turn burner nozzles or sets of burner nozzles on or off. To operate the system effectively, the production flow rate must be monitored and the number of burner nozzles used adjusted accordingly.

DESCRIPTION OF DRAWINGS

Like reference symbols in the various drawings indicate like elements.

DETAILED DESCRIPTION

Figure 1:
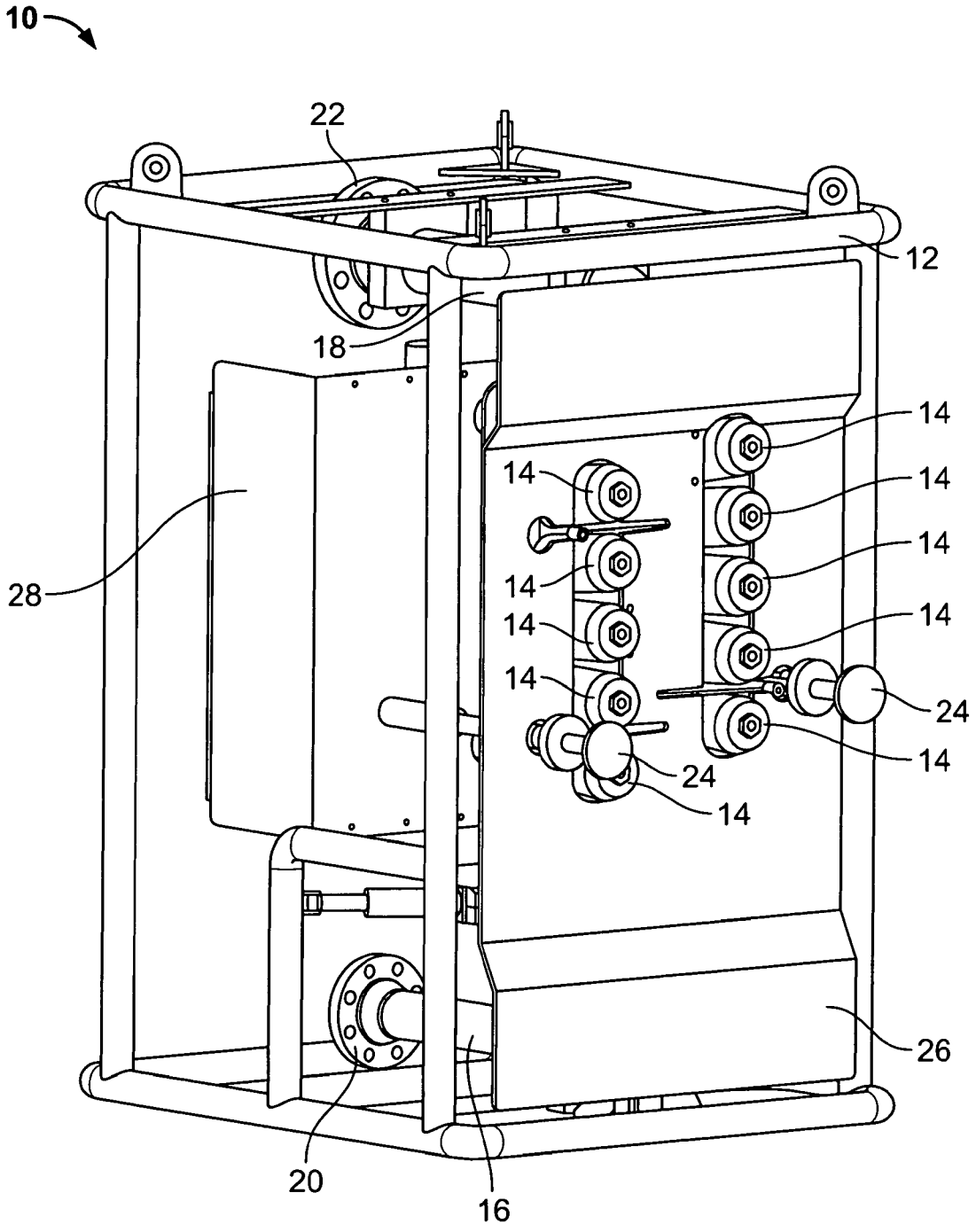
FIG. 1 is a perspective view of an example well test burner system.

FIG. 1 is a perspective view of an example well test burner system 10. The well test burner system 10 is of a type that could be used to burn product produced from a well (e.g., substantially crude oil), for example, during its test phase. In certain instances, the well test burner system 10 is mounted to a boom extending outward from the side of an offshore drilling platform. Alternately, the well test burner system 10 could be mounted to a skid for use with a land-based well.

The well test burner system 10 includes a frame 12 that carries the other components of the well test burner system 10 and is adapted to be mounted to a boom or a skid. The frame 12 is shown as being tubular and defining a substantially cubic rectangular shape, but could be other configurations.

The frame 12 carries one or more burner nozzles 14 adapted to receive air and well product. The burner nozzles 14 combine the air and well product in a specified ratio and expel the air and product mixture for burning. One or more of the burner nozzles 14 can be configured with an automatic valve configured to automatically adjust a ratio of the amounts of air and well product combined based on a characteristic of the well product (e.g., flow rate, viscosity and/or other characteristics). Ten burner nozzles 14 are shown, but fewer or more could be provided. The burner nozzles 14 are arranged vertically in two parallel columns. In other instances, the burner nozzles 14 can be arranged differently, for example, with fewer or more columns or in a different shape, such as in a circle, offset triplets, or in another different manner.

The burner nozzles 14 are coupled to and receive air via an air inlet pipe 18. They are also coupled to and receive product to be disposed of via a product inlet pipe 16. In certain instances, the air inlet pipe 18 and the product inlet pipe 16 are rigid pipes (as opposed to flexible hose). They are provided with flanges 22, 20, respectively, to couple to a line from an air compressor and a line providing the well product to be disposed of The frame 12 carries one or more pilot burners 24 that are coupled to and receive a supply of pilot gas. Two pilot burners 24 are shown flanking the columns of burner nozzles 14, and each is positioned between the first two burner nozzles 14 in each column. The pilot burners 24 burn the pilot gas to maintain a pilot flame that lights the air/product mixture expelled from burner nozzles 14 adjacent to the pilot burners 24. The remaining burner nozzles 14 are arranged so that they expel air/product mixture in an overlapping fashion, so that the burner nozzles 14 lit by the pilot burners 24 light adjacent burner nozzles 14, and those burner nozzles 14, in turn, light adjacent burner nozzles 14, and so on so that the air/product mixture expelled from all burner nozzles 14 is ignited.

In the configuration of FIG. 1, the pilot burners 24 are arranged to produce a pilot flame directed inward across the burner nozzles 14, where the pilot burner 24 on one side produces a flame directed toward the opposite pilot burner 24. This arrangement facilitates lighting the burner nozzles 14 arranged in vertical columns, because no matter which direction the wind blows the flame from the pilot burner 24, the flame always crosses a burner nozzle 14. Therefore, if the burner nozzles 14 are arranged to light one another, as described above, the well test burner system 10 automatically lights and re-lights while the pilot burners 24 are operating. In other arrangements of burner nozzles 14, the pilot burners 24 can be differently arranged.

The frame 12 carries one or more heat shields to reduce transmission of heat from the burning product to components of the burner system 10, as well as to the boom and other components of the platform. For example, the frame 12 can include a primary heat shield 26 that spans substantially the entire front surface of the frame 12. The frame 12 can also include one or more secondary heat shields to further protect other components of the burner system 10. For example, a secondary heat shield 28 is shown surrounding a control box of the burner system 10. Fewer or more heat shields can be provided.

Figure 2:
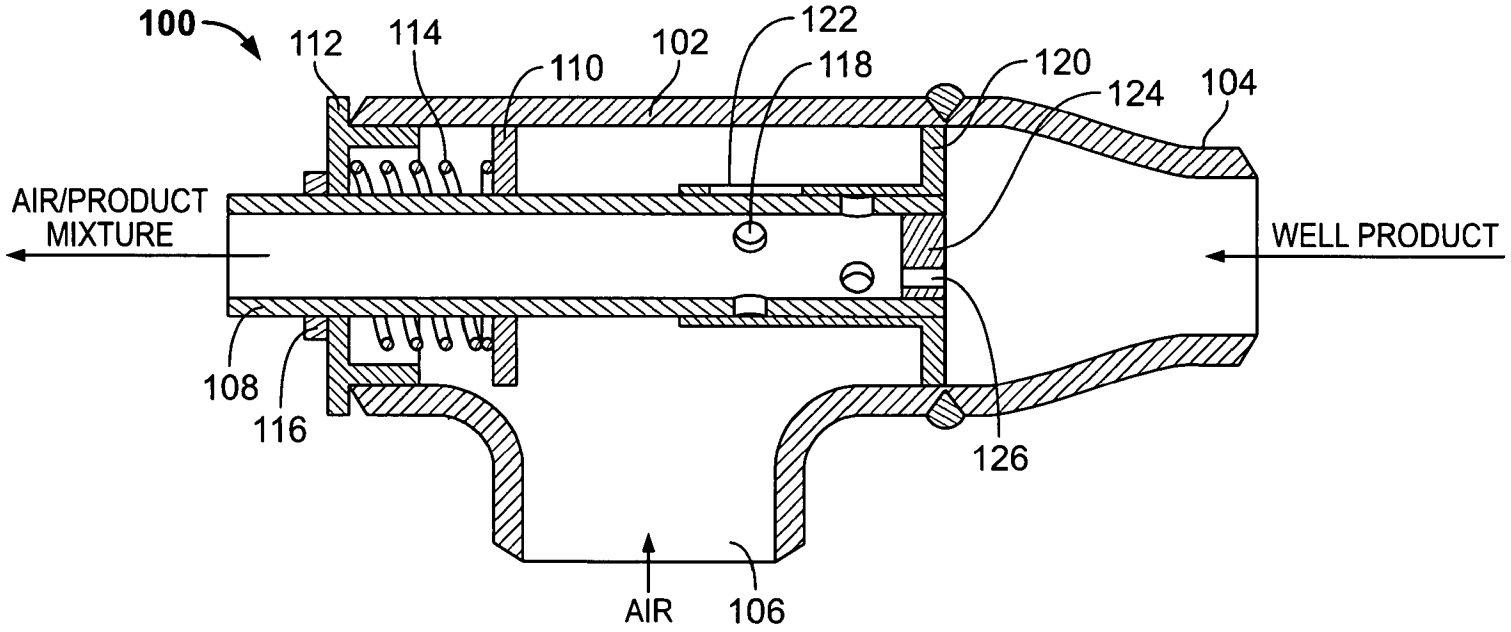
FIG. 2 is a half cross-sectional view of an example burner nozzle that can be used in the well test burner system of FIG. 1.

FIG. 2 shows an example burner nozzle 100 that can be used as burner nozzle 14. The burner nozzle 100 is shown in half cross-section to show its features and operation. The burner nozzle 100 has an exterior housing 102 that defines a well product inlet 104 at one end and an air inlet 106 intermediate the ends. The well product inlet 104 is coupled to a supply of the well product to be disposed of (e.g., product inlet pipe 16).

In certain instances, the housing 102 is constructed from standard, ready-made, off-the-shelf (as opposed to custom, one-off made) pipe parts. For example, the housing 102 can be constructed of a standard pipe tee with a reducing fitting welded to an end. The air inlet 106 is coupled to a supply of air (e.g., air inlet pipe 18). In certain instances, the housing 102 is constructed from a standard stainless steel 3"×3" tee and 3"×2" reducing fitting. Using standard, ready-made pipe parts can reduce the manufacturing cost over a burner nozzle constructed from one-off parts.

The burner nozzle 100 includes an automatic valve in its interior that is configured to receive the air and well product from the well product inlet 104 and air inlet 106, and to combine the air and well product, automatically adjusting a ratio air and well product based on a characteristic of the well product. The resulting air and well product mixture is expelled from the burner nozzle 100 via an air/well product mixture outlet, ignited by a pilot flame or a flame from an adjacent burner nozzle.

To this end, the housing 102 includes a collar 120. The collar 120 has a substantially tubular portion and a flange portion extending radially outward from the tubular portion. The flange portion of the collar 120 is affixed to the interior of the housing 102 near, but spaced apart from the well product inlet 104. The flange portion of the collar 120 seals the well product inlet 104 from the remainder of the interior of the housing 102. An end cap 112 is affixed to an end of the housing 102 opposite the well product inlet 104. In certain instances the end cap 112 is threaded into mating threads of the housing 102. In certain instances, the end cap 112 is made of an aluminum bronze material that prevents the nut from galling the threads of the housing 102.

The tubular portion of the collar 120 is shown internally, concentrically receiving an elongate nozzle tube 108. In other instances, the nozzle tube 108 could internally receive the tubular portion of the collar 120. The nozzle tube 108 extends through an opening in the end cap 112 and out an end of the housing 102. The nozzle tube 108 is carried by the tubular portion of the collar 120 and the end cap 112 to move axially within housing 102.

The nozzle tube 108 has a radial flange 110 intermediate its ends. A spring 114 is resides between and bearing on the end cap 112 and the flange 110, springingly biasing the nozzle tube 108 towards the well product inlet 104 of the housing 102. A nut 116 is threaded onto the nozzle tube 108, exterior the housing 102, and limits the movement of the nozzle tube 108 towards the well product inlet 104. The spring biases the nozzle tube 108 to an initial position (shown in the figure) where the nut 116 of the nozzle tube 108 abuts the end cap 112 and the nozzle tube 108 is at the extent of its movement.

The tubular portion of the collar 120 has one or more openings 122 in its sidewall, and the nozzle tube 108 has one or more apertures 118 in its sidewall. FIG. 2 shows three axially spaced apertures 118 in the nozzle tube 108 and a single elongate slot or opening 122 in the tubular portion of the collar 120 sized to encompass all of the apertures. Other numbers, configurations and shapes of openings 122 and apertures 118 can be used. The opening 122 and apertures 118 are in communication with the air inlet 106 of the housing 102 and operate as air inlets to allow air to enter the interior of the nozzle tube 108. The nozzle tube 108 and tubular portion of the collar 120 operate as concentric sleeves of a sleeve valve to meter flow between the air inlet 106 and the interior of the nozzle tube 108. To this end, when the apertures 118 align with the opening 122, the overlap defines a flow area through which the air inlet 106 of the housing 102 can communicate with the interior of the nozzle tube 108. The remainder of nozzle tube 108 covers and seals against flow through the remainder of the opening 122. The nozzle tube 108 can move axially to align all or fewer than all of the apertures 118 with the opening 122, and thus vary the flow area.

With the nozzle tube 108 in the initial position (shown in FIG. 2), the flow area is at a minimum flow area with the fewest apertures 118 aligned with the opening 122. As the nozzle tube 108 is moved away from the initial position (i.e., away from well product inlet 104) additional apertures 118 align with the opening 122 and the size of the flow area increases. Thus, more air can flow from the air inlet 106, through the elongate opening 122 and apertures 118 into the interior of the nozzle tube 108, than in the initial position. Adjusting the position of the nut 116 on the nozzle tube 108 allows adjustment of the initial position, how many of the apertures 118 in the nozzle tube 108 are aligned with the opening 122 and the size of the flow area in the initial position.

The end of the nozzle tube 108 extending out of the housing 102 (i.e., past the end cap 112) defines an air/well product mixture outlet of the burner nozzle 100. The opposing end of the nozzle tube 108 (i.e., toward the well product inlet 104) is closed by a cap 124. The cap 124 has one or more well product inlets 126 into the interior of the nozzle tube 108. The well product inlets 126 are positioned to receive well product from the well product inlet 104 of the housing 102. The well product and air mix in the nozzle tube 108, the mixture exits the burner nozzle 100 through the outlet in the end of nozzle tube 108, and is ignited by the pilot burner and/or another burner nozzle.

In certain instances, the inlet 126 is configured to promote turbulence in the interior of the nozzle tube 108. For example, in certain instances, the inlet 126 can be oriented so that the well product is directed to impinge on the inside wall of the nozzle tube 108. In an example having more than one inlet 126, the inlets 126 can be spaced apart to impinge on the wall at spaced apart locations (e.g., 180° apart and/or other spacing). In another example having more than one inlet 126, the inlets 126 can be spaced apart and oriented so that the flows of well product converge at a point in the nozzle tube 108. In certain instances the inlets 126 can have a spiral internal profile to introduce a spiral rotation to the incoming well product. Similarly, the apertures 118 and/or opening 122 can be configured to promote turbulence. For example, the apertures 118 and/or opening 122 can constrict the flow area of the air, and produce high velocity air that jets transversely into the interior of the nozzle tube 108, impinging on the incoming well product. The turbulence promotes efficient mixing of the air and well product and efficient atomization of the well product.

The inlet 126 into the nozzle tube 108 is an orifice of a specified flow area and specified flow characteristics selected to cause a specified pressure differential upstream and downstream of the cap 124, particularly with a lower pressure downstream of the cap 124 (in the interior of the nozzle tube 108) than upstream of the cap 124. The pressure differential creates a force that tends to draw the nozzle tube 108 from the initial position away from the inlet 126 and increases the flow area of air into the nozzle tube 108 automatically without human or other intervention. The spring 144 provides a counteracting force on the nozzle tube 108 tending to move the nozzle tube 108 toward the initial position and reduce the flow area of the air into the nozzle tube 108 when the pressure differential decreases, again automatically without human or other intervention.

As the flow rate of the well product increases, the pressure differential across the cap 124 increases and tends to move the nozzle tube 108 to increase the air flow (i.e., flow area) into the nozzle tube 108. In an example having multiple, axially spaced apertures 118 in the nozzle tube 108, as the flow rate of the well product increases, more apertures 118 align with the opening 122 in the collar 120. Therefore, as more well product is supplied into the burner nozzle 108 and nozzle tube 108, more air is also supplied into the nozzle tube 108. When the flow rate of the well product decreases again, the pressure differential across the cap 124 decreases and tends to move the nozzle tube 108 to decrease the air flow (flow area) and, in certain instances, can move the nozzle tube 108 to the initial position. Changes in well product viscosity are similarly adjusted for, increasing the flow area of the air when the viscosity increases and decreasing the flow area of the air when the viscosity decreases. The resulting burner nozzle 100 can have a higher turndown and operational range than a burner nozzle of fixed air and/or well product inlet flow area.

The inlet 126 and/or spring rate of the spring 114 can be selected together with the number and position of the apertures 118 and/or opening 122 to yield a flow area of the air that changes in a specified relationship to a characteristic of the incoming well product. In certain instances, the specified relationship can be selected to cause the well product and air supplied into the nozzle tube 108 to be at or approximately at a specified ratio that promotes efficient combustion of the well product. For example, the specified ratio can be selected to achieve a stoichiometric or approximately stoichiometric ratio of the well product and air when the mixture exits the burner nozzle 100, accounting for the air entrained into the mixture after it exits the burner nozzle 100. In certain instances, the apertures 118 and opening 122 can be configured to operate the burner nozzle 100 in two or more distinct modes. For example, FIG. 2 could operate in three modes—a low flow rate/viscosity mode at the initial position, with a first aperture 118 aligned with the opening 122, an intermediate flow rate/viscosity mode just off the initial position and with the first two apertures 118 aligned with the opening 122, and a high flow rate/viscosity mode near the maximum movement of the nozzle tube 108 and with an additional aperture or apertures 118 aligned with the opening 122.

In certain instances, some or all of the burner nozzles 100 of a well test burner system can be configured to have a different specified relationship between the flow area of the air and the characteristic of the incoming well product. The different specified relationships of the burner nozzles 100 can be arranged to provide a staging effect to the nozzles of the well test burner system, so that some of the burner nozzles 100 operate to respond to increases in flow rates/viscosities before others to more efficiently accommodate different flow rates and/or viscosities of well product. For example, in an instance with burner nozzles 100 each having a low flow rate/viscosity mode and a high flow rate/viscosity mode, a first set of the burner nozzles can be configured to transition to their high flow rate/viscosity mode at a lower flow rate/viscosity than those of a second set. Thus, if the flow rate/viscosity through the well test burner system is less than the high flow rate/viscosity mode of the second set of burner nozzles, they will remain at their low flow rate/viscosity mode directing flow to the first set of burner nozzles.

A number of variations have been described. Nevertheless, it will be understood that additional modifications may be made. Accordingly, other embodiments are within the scope of the following claims.

What is claimed is:

1. A well test burner system, comprising:

a plurality of burner nozzles, at least one of the burner nozzles comprising:

a well product inlet;

an air inlet;

an air/well product mixture outlet; and an automatic valve configured to automatically adjust a ratio of air and well product supplied to the air/well product mixture outlet based on the well product received via the well product inlet, the automatic valve comprising:

a first sleeve with a sleeve air inlet; and a second sleeve moveable relative to the first sleeve selectively covering the air inlet in the first sleeve, the second sleeve springingly biased towards a minimum flow area of the sleeve air inlet, and where the at least one burner nozzle further comprises a spring of a predetermined spring rate biasing the second sleeve toward the minimum flow area, and where another of the plurality of burner nozzles comprises a spring of a different spring rate biasing a sleeve of an automatic valve of the other burner nozzle toward a minimum flow area of a sleeve air inlet of the other burner nozzle.

2. The well test burner system of claim 1, where the sleeve air inlet is automatically changeable in flow area in response to a flow rate of the well product received from the well product inlet.

3. The well test burner system of claim 1, where the sleeve air inlet is automatically changeable in flow area in response to a viscosity of well product received from the well product inlet.

4. The well test burner system of claim 1, where the second sleeve comprises a plurality of apertures into an interior of the second sleeve and the second sleeve is moveable relative to the first sleeve to align different numbers of the apertures with the sleeve air inlet of the first sleeve.

5. The well test burner system of claim 1, where the second sleeve comprises a sleeve well product inlet and the at least one burner nozzle is configured to move the second sleeve with force from a differential pressure upstream and downstream of the well product inlet.

6. The well test burner system of claim 5, where the greater the differential pressure upstream to downstream of the sleeve well product inlet, the less the second sleeve covers the air inlet into the first sleeve.

7. The well test burner system of claim 5, where the second sleeve comprises the air/well product mixture outlet out of the at least one burner nozzle.

8. The well test burner system of claim 5, where the sleeve well product inlet of the second sleeve is configured to promote turbulence in a nozzle tube of the at least one burner nozzle.

9. The well test burner system of claim 1, where the automatic valve of the other burner nozzle is configured to automatically adjust the ratio of air and well product supplied to an air/well product mixture outlet of the other burner nozzle at a different rate than the automatic valve of the at least one burner nozzle.

10. The well test burner system of claim 1, where a largest diameter of the air/well product mixture outlet is smaller than a largest diameter of the well product inlet.

11. The well test burner system of claim 1, where a largest diameter of the air/well product mixture outlet is smaller than a largest diameter of the air inlet.

12. The well test burner system of claim 1, where the second sleeve is axially moveable relative to the first sleeve to selectively cover the air inlet in the first sleeve.

13. The well test burner system of claim 1, where the automatic valve is configured to automatically adjust a ratio of air and well product supplied to the air/well product mixture outlet without a controller.

14. The well test burner system of claim 1, where the automatic valve is configured to automatically adjust a ratio of air and well product supplied to the air/well product mixture outlet without electricity.

15. The well test burner system of claim 1, where the second sleeve is moved by well product acting on the second sleeve.

16. The well test burner system of claim 1, where the second sleeve is received within the first sleeve.

* * * * *